US005256843A

United States Patent [19]

Chiba et al.

[11] Patent Number: 5,256,843

[45] Date of Patent: Oct. 26, 1993

[54] KEYBOARD SWITCH AND METHOD OF MANUFACTURING THE SAME

[75] Inventors: Toshimi Chiba; Sadao Tachibana; Zenzou Tozuka, all of Tokyo, Japan

[73] Assignee: Oki Electric Industry Co., Ltd., Tokyo, Japan

[21] Appl. No.: 836,980

[22] Filed: Feb. 19, 1992

[30] Foreign Application Priority Data

Feb. 27, 1991 [JP] Japan ..... 3-058049

[51] Int. Cl.[5] ..... H01H 3/12

[52] U.S. Cl. ..... 200/517

[58] Field of Search ..... 200/517, 516, 512, 5 A, 200/314

[56] References Cited

U.S. PATENT DOCUMENTS

| | | | |
|---|---|---|---|
| 4,408,252 | 10/1983 | Voge et al. | 200/517 |
| 4,489,227 | 12/1984 | Lamarche | 200/314 |
| 4,511,769 | 4/1985 | Sahakian et al. | 200/517 |
| 4,772,769 | 9/1988 | Shumate | 200/314 |
| 5,115,106 | 5/1992 | Weiland et al. | 200/517 |

*Primary Examiner*—Renee S. Luebke

*Attorney, Agent, or Firm*—Spencer, Frank & Schneider

[57] ABSTRACT

A keyboard switch having a membrane contact point sheet and a push button key for pressing down a contact point portion of the membrane contact point sheet, further includes a housing including a base portion and a casing portion, a key top which is slidably supported in the casting portion and has a contact point pressing portion projecting toward the base portion in an area extending outside a periphery of the casing portion, and a biasing member for biasing the key top toward a home position. The membrane contact point sheet is disposed on the base portion of the housing so that the contact point portion is confronted with the contact point pressing portion, and is formed in a three-layered structure, including an upper contact point sheet, a spacer, and a lower contact point sheet. The contact point portion has a window hole provided in the spacer. A first contact point is formed on a lower surface of the upper contact point sheet at a place corresponding to the window hole and a second contact point is formed on an upper surface of the lower contact point sheet also at a place corresponding to the window hole. The biasing member is a spring member disposed between the casing portion and the contact point pressing portion formed on the key top.

7 Claims, 5 Drawing Sheets

KEYBOARD SWITCH AND METHOD OF MANUFACTURING THE SAME

BACKGROUND OF THE INVENTION

1. Field of the Invention

The present invention relates to a keyboard switch which is used for a data inputting device, such as a keyboard for an electronic instrument, and a method of manufacturing the same.

2. Prior Art

FIG. 6 is a schematic longitudinal cross-sectional view showing an embodiment of a conventional keyboard switch.

In FIG. 6, the keyboard switch 40 is mainly composed of a membrane contact point sheet 41, a push button key 42 and a reinforcing plate 43.

More in detail, the membrane contact point sheet 41 is composed of integrally laminated flexible thin plates of an upper contact point film 44, a spacer 45 and a lower contact point film 46. The membrane contact point sheet 41 has a plurality of contact portions 47 at positions where the push button keys 42 are mounted. A single contact portion and a single push button are illustrated in FIG. 6. A through hole 48 is formed outside the contact portion 47 on the membrane contact point sheet 41.

The membrane contact point sheet 41 is mounted on the reinforcing plate 43, on which a through hole 49 is formed so as to align with the through hole 48 near the contact points 47. The push button key 42 is composed of a housing 50, a key top 51, a return spring member 52 and a pressing spring member 53. The housing 50 is composed of a hollow lower housing portion 50*a* having an opening at the lower surface thereof and an upper housing portion 50*b* which projects upward from the upper surface of the lower housing portion 50*a*. Provided at the center of the upper housing portion 50*b* is a through hole 54 which communicates with the inside of the lower housing portion 50*a*. Furthermore, provided on the lower surface of the lower housing portion 50*a* is a threaded hole 55 used with the hole 48 of the membrane contact point sheet 41. The key top 51 comprises a key lever portion 51*a* slidably inserted into the through hole 54 of the upper housing portion 50*b* and a key top portion 51*b* integrally formed on the upper end of the key lever portion 51*a*. Provided between the key top 51 and the housing 50 is a retaining pawl, not shown, for preventing the key top from dropping out of the housing 50.

This push button key 42 is assembled as follows. The spring member 52 is arranged around the periphery of the upper housing portion 50*b*. Then the key lever portion 51*a* is inserted into the through hole 54 while compressing the spring member 52. When it is inserted into a given depth so that the retaining pawl enters the lower housing portion 50*a*, the retaining pawl retains the lower housing portion 50*a* so as to prevent the key lever portion 51*a* from dropping out of the lower housing portion 50*a*. Thereafter, the spring 53 for pressing down the contact point 47 is mounted on the lower end of the key lever portion 51*a* projecting into the lower housing portion 50*a*.

Then the push button key 42, the membrane contact point sheet 41 and the reinforcing plate 43 are combined to assemble the keyboard switch. Namely, the membrane contact point sheet 41 is arranged on the reinforcing plate 43. Thereafter, the push button key 42 is arranged on the membrane contact point sheet 41 so as to align with the contact portion 47. At this state, a screw 56 is screwed into the threaded hole 55 through the through holes 49 and 48. As a result, the membrane contact sheet 41 is fixedly mounted on the reinforcing plate 43 and at the same time the push button key 42 is fixedly mounted on the membrane contact sheet 41.

Consequently, the keyboard switch 40 constructed as set forth above requires the upper housing portion 50*b* a certain length DO to guide the key lever portion 51*a*.

In order to reduce the entire height of the keyboard switch 40, it is necessary to reduce the stroke of the key top 51 or shorten the length DO of the sliding portion by reducing the height of the key lever portion 51*a* or the housing 50. However, since the appropriate stroke is supposed to be 3 to 5 mm, in this kind of keyboard to thereby limit the reduction of the stroke, it has been difficult to realize a keyboard switch having enough key top stroke, an excellent pressing touch and less entire height, and the keyboard switch has already reached its structural limit.

SUMMARY OF THE INVENTION

The object of the present invention is to provide a keyboard switch capable of reducing the entire height, keeping enough key top stroke and improving the pressing touch.

DESCRIPTION OF THE PREFERRED EMBODIMENT

A keyboard switch according to an embodiment of the present invention will be described with reference to drawings hereinafter.

Figure 1:
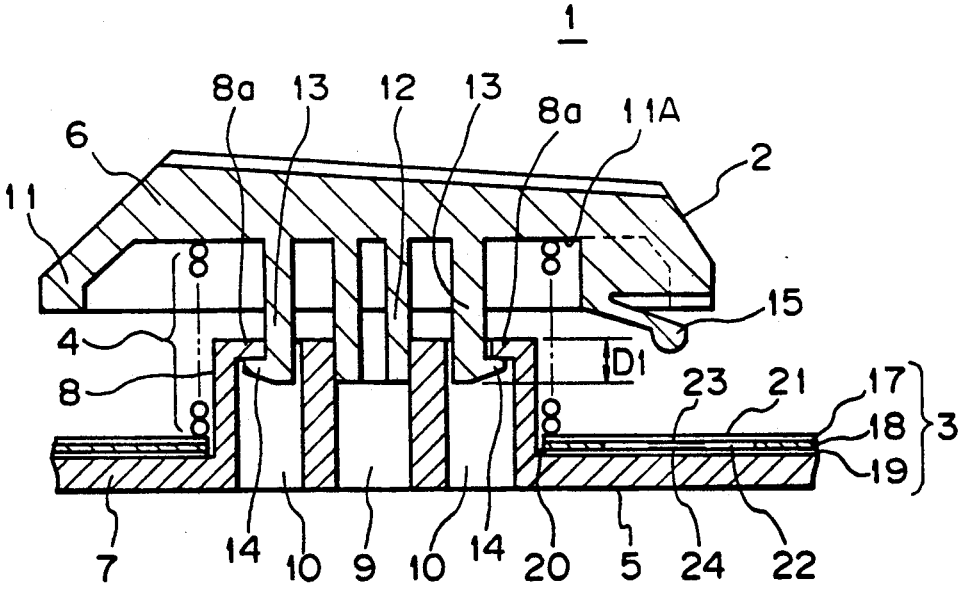
FIG. 1 is a schematic longitudinal cross-sectional side view showing a keyboard switch according to the present invention.

FIG. 1 is a schematic longitudinal cross-sectional side view showing an embodiment of a keyboard switch according to the present invention.

In FIG. 1, a keyboard switch 1 is mainly composed of a push button key 2, a membrane contact point sheet 3, and a spring member 4 composed of a coil spring, etc. for returning a key top to its home position.

More in detail, the push button 2 comprises a housing 5 and a key top 6 arranged on the housing 5.

The housing 5 is integrally composed of a flat base portion 7 and a cylindrical casing portion 8 projecting upward from the upper surface of the base portion 7, both of which are made of a plastic material. The casing portion 8 has a first guide hole 9 vertically penetrating at the center thereof and second guide holes 10 disposed on both sides of the first guide hole 9. A ceiling 8*a* closes partially the upper portion of the second guide hole 10.

The key top 6 comprises a key top portion 11, a key lever portion 12, which projects downward from the lower surface of the key top portion 11, and a pair of retaining pieces 13, 13, which also project downward from the lower surface of the key top portion 11, wherein the key lever portion 12 can be slidably inserted into the first guide hole 9 of the casing portion 8. Each of the pair of retaining pieces 13 and is confronted with each second guide hole 10 when the key lever portion 12 is confronted with the first guide hole 9. At this state, the key lever portion 12 is pushed into the first guide hole 9 and at the same time the pair of retaining pieces 13 are pushed into the second guide holes 10 so that the key lever portion 12 and each retaining piece 13 are inserted into the corresponding holes 9 and 10. After the completion of insertion, retaining pawls 14 provided at the tip ends of the retaining pieces 13 are retained by the inner side of the ceilings 8*a* so as to prevent the key top 6 from dropping from the casing portion 8. A contact point pressing portion 15 is integrally formed on the lower surface of the key top potion 11 and extends outside of the casing portion 8 when the key top 6 is attached to the housing 5. The contact point pressing portion 15 is of a tongue-shape extending downward from the lower side of the key top portion 11 toward the outer side thereof and is elastically deformable in the vertical direction. Although it is not shown in FIG. 1, through holes 16 (refer to FIG. 3) for positioning the housing 5 are defined at the left and right sides of the housing 5 of the push button 2.

The membrane contact point sheet 3 is composed of an upper contact point film 17, a spacer 18 and a lower contact point film 19, which are laminated in turn to form a thin plate, and each of which is made of polyester, etc., and is flexible. A plurality of openings 20 are formed in the sheet 3 to receive the plurality of casing portions 8 and vertical through holes 25 for positioning the housing 5 (refer to FIG. 3), also are formed in the sheet 3. Furthermore, each contact point portion 21 is provided at a position corresponding to the contact point pressing portion 15 of each key top portion 11. The contact point portion 21 has a window hole 22 provided on the spacer 18 and contact points 23 and 24 which are respectively formed by applying a conductive ink to the lower surface of the upper contact point sheet 17 and the upper surface of the lower contact point sheet 19 corresponding to the window hole 22. The contact point 23 is electrically connected to printed wiring (not shown) formed on the lower surface of the upper contact point sheet 17 and the contact point 24 is electrically connected to printed wiring (not shown) on the upper surface of the lower contact point sheet 17. In the membrane contact point sheet 3, the contact points 23 and 24 are usually separated from each other (OFF) by the spacer 18. When the contact point 23 is pressed down by pressing the upper surface of the upper contact point sheet 17, the contact point sheet 17 is deformed toward side of the lower contact point sheet 19 and the contact point 23 is contacted to the contact point 24 so that the keyboard switch is turned ON.

A method of manufacturing the keyboard switch 1 will be described with reference to FIGS. 1 and 3 hereinafter.

Figure 3:
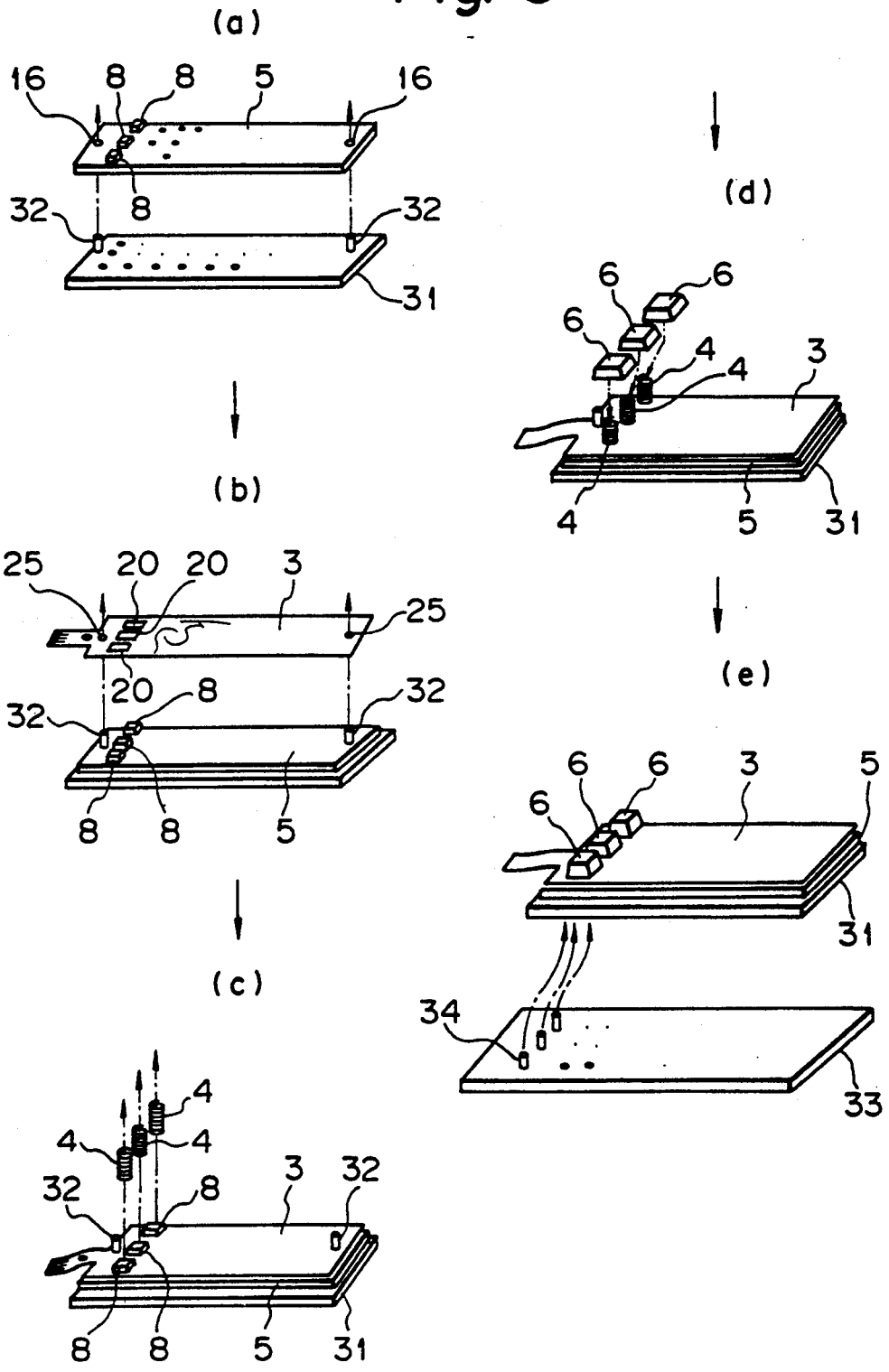
FIGS. 3(*a*) to 3(*e*) are views for explaining the manufacturing method of the keyboard switch in FIG. 1.

As shown in FIG. 3(*e*), a plate-shaped jig 31 and a plate-shaped printing jig 33 are prepared before assembling the keyboard switch. The jig 31 has a pair of pins 32, which project upward therefrom in the direction corresponding to the positioning holes 16 of the housing 5 and the positioning holes 25 of the membrane contact sheet 3. The method of manufacturing the keyboard switch comprises the steps (a) to (e) which will be described in this order hereinafter.

Step(a): The housing 5 is placed on the jig 31 so that the pins 32 are aligned with the holes 16. The pins 32 are inserted into the holes 16 so as to position the housing 5 relative to the jig 31 in the longitudinal direction thereof.

Step(b): The membrane contact point sheet 3 is placed on the housing 5 laid on the jig 31 so that the pins 32 is aligned with the holes 25. At this time, the casing portions 8 projecting from the base portion 7 of the housing 5 project upward through the openings 20 of the membrane contact point sheet 3.

Step(c): Each spring member 4 is arranged around each casing portion 8 on the membrane contact point sheet 3.

Step(d): The key lever portion 12 is aligned with the first guide hole 9 and the retaining pieces 13 are positioned to the second guide holes 10, and at this state the key tops 6 are pressed toward the housing portion 5. Then, the key lever portion 12 is inserted into the first guide hole 9 and the retaining pieces 13 are inserted into the second guide holes 10 while the spring members 4 are compressed between the key top portion 11 and the membrane contact point sheet 3. After the completion of insertion, the retaining pawls 14 provided at the tip ends of the retaining pieces 13 contact the inner surfaces of the ceilings 8*a* so as to prevent the key tops 6 from dropping out of the housings 5, so that the assembling of the keyboard switch 1 is almost completed.

The keyboard switch 1, which has been subjected to the steps (a) to (d), is placed on the printing jig 33. Thereafter, sliding pins 34, which are provided on the printing jig 33, are projected so as to push up the keyboard switch 1, whereby the key tops 6 are subjected to the printing on the upper surface thereof by a printing device, not shown.

Consequently, according to this method of manufacturing the keyboard switch, the components can be assembled one by one oriented in the same direction without frequently turning over the components during assembling, which contributes to the accomplishment of automatic assembly.

Figure 2:
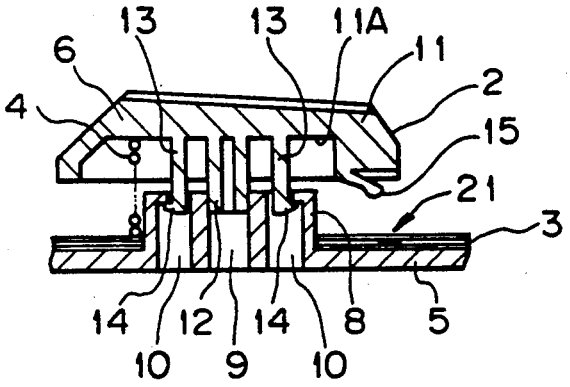
FIGS. 2(*a*)–2(*c*) are views for explaining the operation of the keyboard switch illustrated in FIG. 1.
Figure 2:
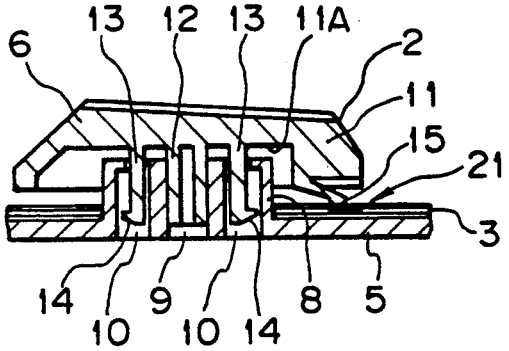
Figure 2:
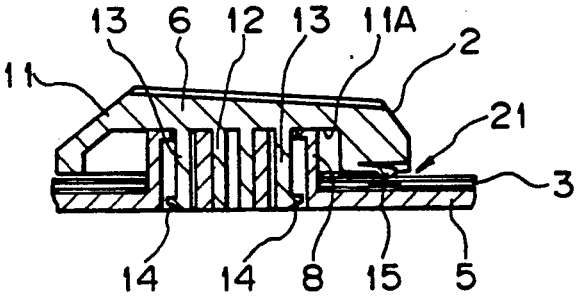

FIGS. 2(*a*) to 2(*c*) are views for explaining the operation of each contact point portion 21 of the keyboard switch 1. The operation of the keyboard switch 1 will be described with reference to FIGS. 1 and 2(*a*) to 2(*c*).

When no pressure is applied to the key top 6, the key top 6 is pushed up by the resilience of the recovering spring member 4 until the retaining pawls 14 contact the inner surfaces of the ceilings 8*a* of the casing portions 8 as shown in FIG. 1 and FIG. 2(*a*). At this state, the contact point pressing portion 15 is moved away from the membrane contact point sheet 3. Therefore, the contact points 23 and 24 are moved away from each other, so that the contact point portion 21 is in the state of "OFF".

Thereafter, when the pressure is applied to the key top 6, the key top 6 is moved downward against the resilience of the return spring member 4 and the resilient contact point pressing portion 15 contacts the upper surface of the upper contact point sheet 17. The upper contact point sheet 17 is deformed toward the lower contact point sheet 19 so that the contact point 23 contacts with the contact point 24 and the keyboard switch 1 is turned on as shown in FIG. 2(*b*). If the key top 6 is further pressed down, the lower surface 11A of the key top portion 11 contacts the upper surface of the casing portion 8 so as to restrict the key top 6 from further pressing down.

When the pressure is released from the key top 6, the key top 6 is pushed back by the resilience of the return spring member 4 so that the contact points 23 and 24 are moved away from each other and the keyboard switch 1 is turned off again.

That is, the keyboard switch 1 according to this embodiment has the contact point portion 21 of the membrane contact point sheet 3 provided outside the casing portion 8 and between the housing 5 and the key top portion 11, so that the slidable location of the key lever portion 12, i.e., the stroke of the key top 6 can be extended to the membrane contact point sheet 44 of the conventional keyboard switch 40. As a result, it is possible to get enough stroke and a consequent sufficient pressing touch to realize a low postured keyboard switch which is small in the entire height. It is also possible to increase the length D1 (refer to FIG. 1) where the key top 6 contacts the casing portion 8 so that the key top 6 can smoothly slide and reliability in operation can be improved. Furthermore, inasmuch as the base portion 7 of the present invention can also serve as the reinforcing plate employed in conventional keyboard switch, it is possible to reduce the number of components and consequently the total weight.

Figure 4:
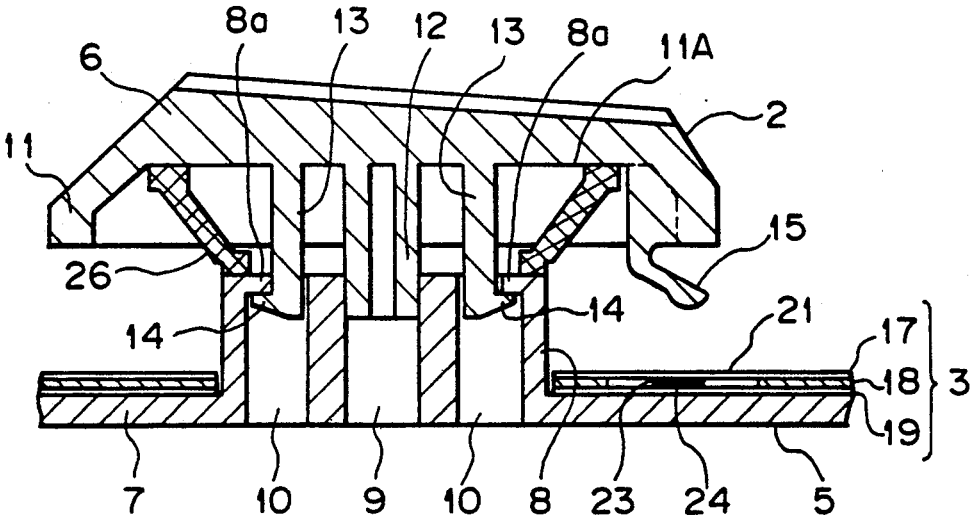
FIG. 4 is a schematic longitudinal cross-sectional side view showing a modified embodiment of the keyboard switch according to the present invention.
Figure 5:
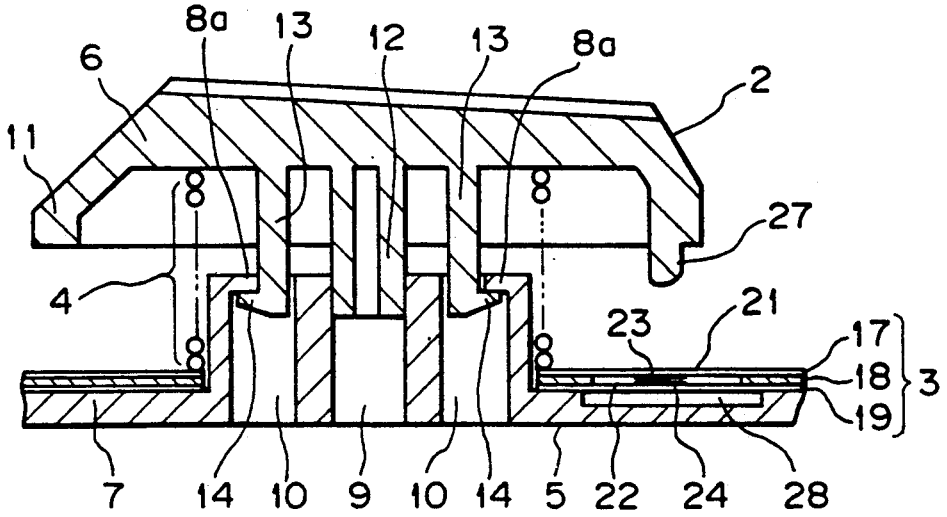
FIG. 5 is a schematic longitudinal cross-sectional side view showing another modified embodiment of the keyboard switch according to the present invention.
Figure 6:
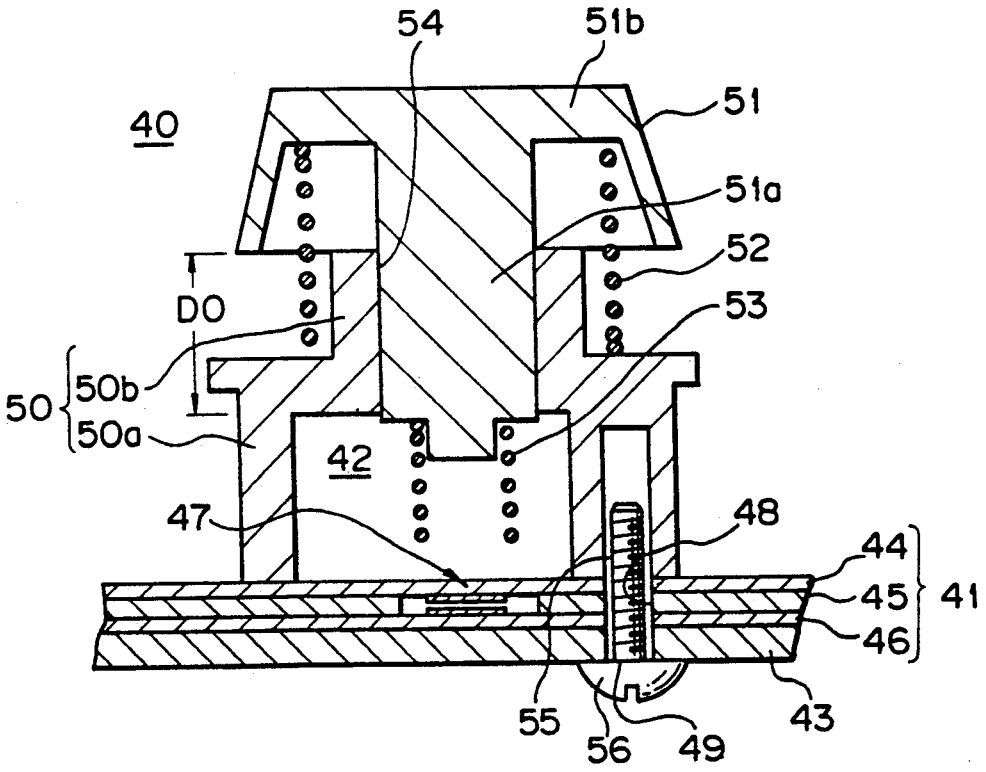
Fig. 6 PRIOR ART
FIG. 6 is a schematic longitudinal cross-sectional side view showing a conventional keyboard switch.

Modified Embodiments (FIGS. 4 and 5)

FIG. 4 is a schematic longitudinal cross-sectional view showing a modified embodiment of the keyboard switch according to the present invention. The same components as shown in FIG. 1 are denoted at the same numerals. The keyboard switch according to this modified embodiment employs rubber serving as a return spring member 26 provided between the ceiling 8 of the casing portion 8 and the lower surface 11A of the key top portion 11 instead of the return spring member 4 of the keyboard switch 1 in FIG. 1. Other operations etc. are the same as those of the keyboard switch 1 shown in FIG. 1.

FIG. 5 is a schematic longitudinal cross-sectional view showing a keyboard switch according to another modified embodiment of the present invention. The same components as those shown in FIG. 1 are denoted at the same numerals. The keyboard switch according to this modified embodiment employs a contact point pressing portion 27 simply projecting downward from the lower surface of the key top portion 12 for pressing down the contact point portion 21 accompanied by the operation to press down the key top 6 so as to simplify a mold (not shown) for forming the key top 6. Other operations etc. are the same as those of the keyboard switch shown in FIG. 1. Denoted at 28 in FIG. 5 is a recess formed on the base portion 7 of the housing 5 for absorbing any excessive pressure applied to the contact point pressing portion 27.

What is claimed is:

1. A keyboard switch comprising a membrane contact point sheet and a push button key for pressing down a contact point portion of the membrane contact point sheet, wherein the keyboard switch further comprises:

a housing including a base portion and a casing portion, a key top which is slidably supported in the casing portion and has a contact point pressing portion formed as part of the keytop and projecting toward the base portion in an area extending outside a periphery of the casing portion, and a biasing member for biasing the key top toward a home position, wherein the membrane contact point sheet is disposed on the base portion of the housing so that the contact point portion is confronted with the contact point pressing portion, wherein the membrane contact point sheet is formed in a three-layered structure, including an upper contact point sheet, a spacer, and a lower contact point sheet wherein the contact point portion of the membrane contact point sheet has a window hole provided in the spacer, wherein a first contact point is formed on a lower surface of the upper contact point sheet at a place corresponding to the window hole, wherein a second contact point is formed on an upper surface of the lower contact point sheet at a place corresponding to the window hole, wherein the contact point pressing portion directly presses the contact point portion of the membrane contact point sheet thereby pressing the first and second contact points together, and wherein the biasing member comprises a spring member disposed between the casing portion and the contact point pressing portion formed on the key top.

2. A keyboard switch according to claim 1, wherein the base portion of the housing is a substantially planar sheet.

3. A keyboard switch according to claim 1, wherein the housing is made of a plastic material.

4. A keyboard switch according to claim 1, wherein the biasing member comprises a coil spring.

5. A method of manufacturing a keyboard switch comprising a housing having a base portion and a casing portion, a key top which is slidably supported in the casing portion and has a contact point pressing portion formed as part of the keytop and projecting toward the base portion and a retaining pawl for retaining the rear surface of the housing, and a biasing member for biasing the key top toward a home position, the method comprising the steps of:

forming a membrane contact point sheet, which has an opening for extending the casing portion therethrough and a contact point portion near the opening, the membrane contact point sheet being formed in a three-layered structure, including an upper contact point sheet, a spacer, and a lower contact point sheet, the contact point portion of the membrane contact point sheet having a window hole provided in the spacer, a first contact point being formed on a lower surface of the upper contact point sheet at a place corresponding to the window hole, a second contact point being formed on an upper surface of the lower contact point sheet at a place corresponding to the window hole, wherein the contact point pressing portion is disposed to directly press the contact point portion of the membrane contact point sheet and thereby press the first and second contact points together;

inserting the casing portion of the housing into the opening;

putting the biasing member on the casing portion, the biasing member comprising a spring member disposed between the casing portion and the contact point pressing portion formed on the key top and inserting the key top into the casing portion to compress the biasing member until the retaining pawl retains the rear surface of the housing.

6. A method of manufacturing the keyboard switch according to claim 5, wherein the retaining pawl is provided on the lower side of the key top.

7. A method of manufacturing a keyboard switch comprising the following steps of:

(a) preparing a membrane contact point sheet having an opening and a contact point portion disposed near the opening;

(b) preparing a housing having a base portion and a casing portion arranged on and extending from a surface of the base portion;

(c) preparing a key top having a retaining piece with a tip end, a projecting key lever portion, a contact point pressing portion projecting downward from the key top and a retaining pawl provided at the tip end of the retaining piece;

(d) preparing a coil-shaped biasing member;

(e) inserting the casing portion of the housing into the opening of the membrane contact point sheet from a rear surface thereof so that the casing portion extends through the opening of the membrane contact point sheet and protrudes from a front surface thereof;

(f) arranging the biasing member around that part of the casing portion which protrudes from the front surface of the membrane contact point sheet;

(g) inserting the key top retaining piece and key lever portion into the casing portion of the housing so that the contact point pressing portion is confronted with the contact point portion of the membrane contact point sheet;

whereupon the biasing member pushes the key top away from the housing base portion and the retaining pawl prevents the key lever portion from coming out of the casing portion.

* * * * *